US011437787B2

(12) United States Patent
Gries et al.

(10) Patent No.: US 11,437,787 B2
(45) Date of Patent: Sep. 6, 2022

(54) SPARK PLUG HOUSING INCLUDING CORROSION PROTECTION ON THE INNER SIDE AND SPARK PLUG AND MANUFACTURING METHOD

(71) Applicant: Robert Bosch GmbH, Stuttgart (DE)

(72) Inventors: Bernhard Gries, Kemmern (DE); Christoph Roland Hoelzl, Kornwestheim (DE); Gabriel Petersen, Bamberg (DE); Herbert Noelscher, Eltmann (DE); Martina Bubrin, Stuttgart (DE); Milan Pilaski, Mannheim (DE); Roland Kraus, Bamberg (DE); Sabrina Rathgeber, Renningen (DE); Tim Bergmann, Hemer (DE); Tina Hirte, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/433,216

(22) PCT Filed: Mar. 2, 2020

(86) PCT No.: PCT/EP2020/055402
§ 371 (c)(1),
(2) Date: Aug. 23, 2021

(87) PCT Pub. No.: WO2020/182509
PCT Pub. Date: Sep. 17, 2020

(65) Prior Publication Data

US 2022/0123531 A1 Apr. 21, 2022

(30) Foreign Application Priority Data

Mar. 14, 2019 (DE) ..... 102019203478.0

(51) Int. Cl.
*H01T 13/06* (2006.01)
*H01T 21/02* (2006.01)

(52) U.S. Cl.
CPC ..... *H01T 13/06* (2013.01); *H01T 21/02* (2013.01)

(58) Field of Classification Search
CPC ..... H01T 13/06; H01T 21/02
See application file for complete search history.

(56) References Cited

U.S. PATENT DOCUMENTS 6,768,249 B1 * 7/2004 Nasu ..... C23C 22/36 313/140
2012/0146483 A1 6/2012 Kadowaki
2013/0249380 A1 * 9/2013 Kodama ..... H01T 13/39 313/141

FOREIGN PATENT DOCUMENTS

DE 2215276 A1 10/1973
DE 4240646 A1 6/1994
(Continued)

OTHER PUBLICATIONS

International Search Report for PCT/EP2020/055402, dated May 12, 2020.

*Primary Examiner* — Kevin Quarterman
(74) *Attorney, Agent, or Firm* — Norton Rose Fulbright US LLP; Gerard Messina

(57) ABSTRACT

A spark plug housing. The spark plug housing includes an inner side, an outer side, and a longitudinal axis, which extends from an end of the spark plug housing facing toward the combustion chamber up to an end of the spark plug housing facing away from the combustion chamber. The spark plug housing includes a circumferential shoulder on its inner side, which is designed so that a spark plug insulator rests thereon, and a corrosion protection layer on its inner side, which is formed on a section of the inner side of the
(Continued)

spark plug housing, the section extending from the end of the spark plug housing facing toward the combustion chamber to at least over the shoulder and along the inner circumference of the spark plug housing.

8 Claims, 2 Drawing Sheets

(56) References Cited

FOREIGN PATENT DOCUMENTS

| | | | |
|---|---|---|---|
| DE | 60002534 | T2 | 11/2003 |
| DE | 102004046895 | A1 | 3/2006 |
| EP | 2546938 | A1 | 1/2013 |
| JP | H02291691 | A | 12/1990 |
| JP | H031472 | A | 1/1991 |

* cited by examiner

SPARK PLUG HOUSING INCLUDING CORROSION PROTECTION ON THE INNER SIDE AND SPARK PLUG AND MANUFACTURING METHOD

FIELD

The present invention relates to a spark plug housing, a spark plug including such a spark plug housing, and a manufacturing method for the spark plug housing.

BACKGROUND INFORMATION

Modern spark plug housings frequently have a coating on their outer side, which is to protect the spark plug housing from corrosion. Such a corrosion protection layer is typically produced by an electrochemical or electroplating or other coating method. Each coating method has its advantages and disadvantages.

SUMMARY

For electroplating, the spark plug housing is placed in a drum or mounted on a rack for the coating. The difficulty arises that the inner side of the spark plug housing may not be coated or may only be coated in a small part, since the electrical field required for the layer formation is shielded in the inner area by the housing itself. In particular spark plug housings including a deep breathing space obtain no or at least not sufficient and uniform coating on their inner side in this method. In the event of unfavorable storage conditions or transportation conditions, this has the result that the spark plug housing already corrodes on its inner side. The spark plug housing may no longer be used. If the corrosion of the breathing space remains unnoticed and the spark plug housing is used for a spark plug, this spark plug has a significantly shorter service life than a spark plug having a non-corroded spark plug housing.

It is an object of the present invention to provide a spark plug housing and a spark plug in which preferably no corrosion occurs in the breathing space of the spark plug housing.

This object may be achieved in the spark plug housing according to example embodiments of the present invention. In accordance with an example embodiment of the present invention, the spark plug housing has an inner side, an outer side, and a longitudinal axis, which extends from an end of the spark plug housing facing toward the combustion chamber to an end of the spark plug housing facing away from the combustion chamber, the spark plug housing including a circumferential shoulder on its inner side, which is designed so that a spark plug insulator rests thereon, in that the spark plug housing includes a corrosion protection layer on its inner side, which is formed on a section of the inner side of the spark plug housing, the section extending from an end of the spark plug housing facing toward the combustion chamber to at least over the shoulder and along the inner circumference of the spark plug housing.

This may yield an advantage that the section on the inner side of the spark plug housing covered by the corrosion protection layer, which delimits the breathing space in a spark plug together with the spark plug insulator and thus forms this breathing space, is protected by the corrosion layer from undesirable corrosion during the storage, during the transportation, and also during the use of the spark plug. It is particularly advantageous that the corrosion protection layer extends from the end of the spark plug housing facing toward the combustion chamber to at least over the shoulder. In a spark plug, the spark plug insulator rests on the shoulder of the inner side of the spark plug housing. The gap between spark plug housing and spark plug insulator is sealed off airtight at the shoulder, frequently together with an inner seal, but also in some cases without an inner seal, so that the gas mixtures arising in the combustion chamber may not penetrate farther into the spark plug housing than up to this inner sealing point at the shoulder. The breathing space thus extends from the end of the spark plug housing facing toward the combustion chamber up to the shoulder, on which the spark plug insulator rests and seals off the gap, frequently together with a sealing core.

In one refinement of the present invention, it is provided that the corrosion protection layer is a layer applied by electroplating. This means that the corrosion layer was applied with the aid of an electroplating method to the surface of the spark plug housing. In particular, in the case of the electroplating method, a very uniform corrosion protection layer results, which is formed sufficiently far on the inner side of the spark plug housing if a coating electrode is placed in the interior of the spark plug housing in the electroplating method, so that a very uniform electrical field results along the longitudinal axis of the spark plug housing for the section to be coated.

Additionally or alternatively, it may be provided that the corrosion protection layer contains nickel and/or zinc. Corrosion layers including or made of these elements are very stable. In particular, the corrosion protection layer is phosphorus-free.

In one advantageous embodiment of the present invention, it is provided that the corrosion protection layer extends at least 1 mm beyond the shoulder in the direction of the end of the spark plug housing facing away from the combustion chamber. It is thus ensured that the corrosion protection layer is formed sufficiently far on the inner side of the spark plug housing so that there is no corrosion directly at the inner sealing point at the shoulder.

It has proven to be particularly advantageous if the corrosion protection layer has a thickness D of at least 2 μm on average, in particular along the circumference of the section and/or along the longitudinal extension of the section. Thickness D is measured perpendicularly to the inner side of the spark plug housing. It has been shown that at a layer thickness of less than 2 μm, possible defects in the corrosion protection layer may extend from the surface of the corrosion protection layer through the layer up into the spark plug housing and thus form possible corrosion paths to the spark plug housing surface. With a layer thickness of at least 2 μm, the probability of such corrosion paths is sufficiently low that the corrosion protection layer has a sufficient protection function.

Furthermore, it is also advantageous if the corrosion protection layer has a uniform thickness, which has not more than 10% difference between the thickest and thinnest point. A point which is significantly thinner than the remaining corrosion protection layer is thus prevented from occurring. At a thinner point, the probability is higher in relation to the remaining corrosion protection layer that corrosion paths exist from the surface of the corrosion protection layer up to the housing. The thinner point is thus a weak point and may have the result that the intended technical effect of the present invention does not occur.

In one embodiment of the spark plug housing in accordance with the present invention, the spark plug housing only has the corrosion layer on its inner side. The production and production costs for a spark plug housing having a good corrosion protection are thus simplified.

In an alternative embodiment of the spark plug housing in accordance with the present invention, the spark plug housing also includes further layers in addition to the corrosion protection layer, in particular one or multiple intermediate layer(s) and/or a sealing layer. The corrosion protection layer, the intermediate layers, and the sealing layer form a layer system, i.e., the various layers rest on one another. The possibility thus results of providing a particularly robust layer system for the corrosion protection of the spark plug housing, which is required in particular for applications for spark plugs in extreme combustion conditions.

Furthermore, the present invention also relates to a spark plug which includes a spark plug housing according to the present invention, a spark plug insulator situated in the spark plug housing, a center electrode situated in the spark plug insulator, and a ground electrode which is situated at the end of the spark plug housing facing toward the combustion chamber, the ground electrode and the center electrode being configured to jointly form a spark gap.

The above-described advantageous technical effects also have an impact accordingly in this spark plug.

Furthermore, the present invention also relates to a method for manufacturing a spark plug housing according to the present invention, in which at least one section on the inner side of the spark plug housing is electroplated using a corrosion protection layer, in that a coating electrode is placed inside the spark plug housing.

This yields the advantage that in this electroplating method, a very uniform corrosion protection layer arises on the inner side of the spark plug housing, which is also formed sufficiently far on the inner side of the spark plug housing. Due to the placement of the coating electrode in the interior of the spark plug housing in the electroplating method, a very uniform electrical field arises along the longitudinal axis of the spark plug housing for the section to be coated. A very uniform corrosion protection layer may thus be applied to the inner side of the spark plug housing.

Further features, possible applications, and advantages of the present invention result from the following description of exemplary embodiments of the present invention, which are shown in the figures.

DETAILED DESCRIPTION OF EXAMPLE EMBODIMENTS

Figure 1:
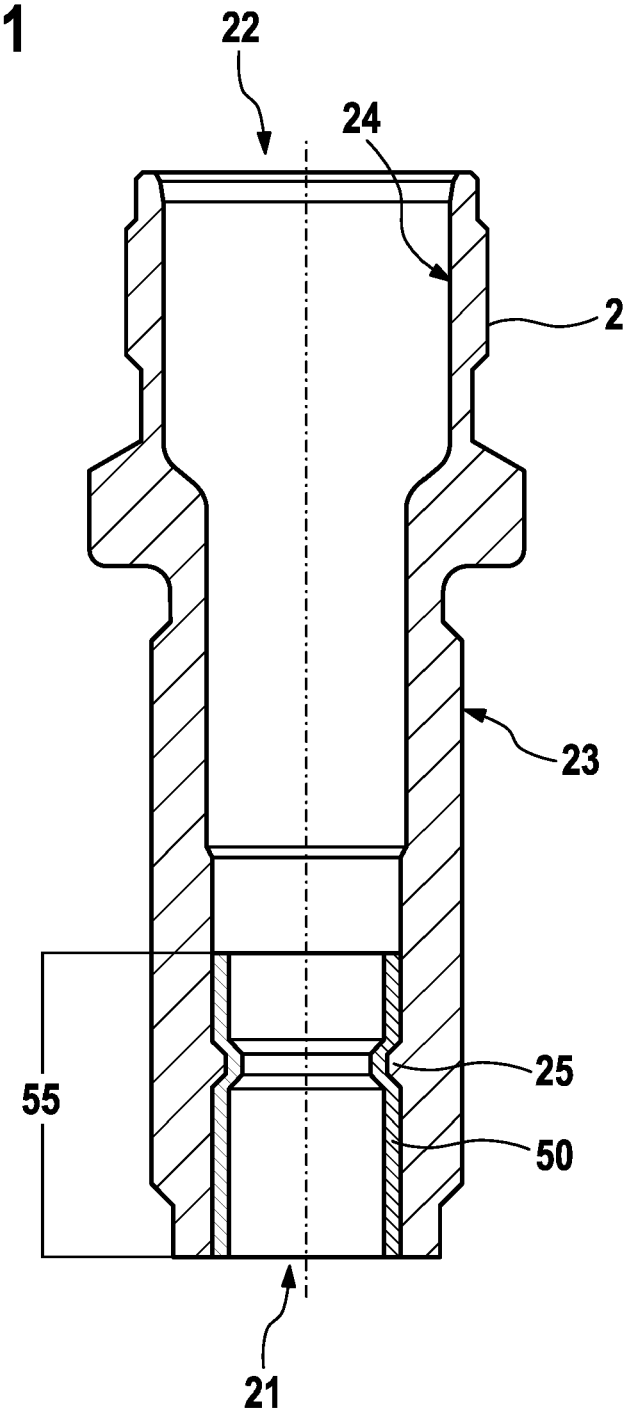
FIG. 1 shows an example embodiment of a spark plug housing according to the present invention.

FIG. 1 shows a spark plug housing 2 according to an example embodiment of the present invention. Spark plug housing 2 includes an inner side 24, an outer side 23, an end 21 facing toward the combustion chamber, and an end 22 facing away from the combustion chamber. A shoulder 25, circumferential around inner side 24, is formed on inner side 24 of spark plug housing 2. This shoulder 25 is designed so that in a spark plug 1 including a spark plug insulator 3, this spark plug insulator 3 rests on shoulder 25.

A corrosion protection layer 50 is applied in one section 55 on the surface of spark plug housing inner side 24. Corrosion protection layer 50 extends from the end of the spark plug housing facing toward the combustion chamber up to at least 1 mm beyond shoulder 25 and along the inner circumference of spark plug housing inner side 24. In this example, corrosion protection layer 50 is formed on a section 55 having a length of at least 4 mm in parallel to the longitudinal axis of spark plug housing 2. Corrosion protection layer 50 includes a preferably uniform layer thickness D at an average of at least 2 μm along its circumference and along its longitudinal extension, the thickest and the thinnest point of the corrosion protection layer differing by not more than 10%.

Corrosion protection layer 50 has preferably been applied with the aid of an electroplating method, a coating electrode having been arranged inside spark plug housing 2 for the coating of spark plug housing inner side 24 with corrosion protection layer 50.

The spark plug housing is typically made of a carbon steel, such as C10 or C22.

Figure 2:
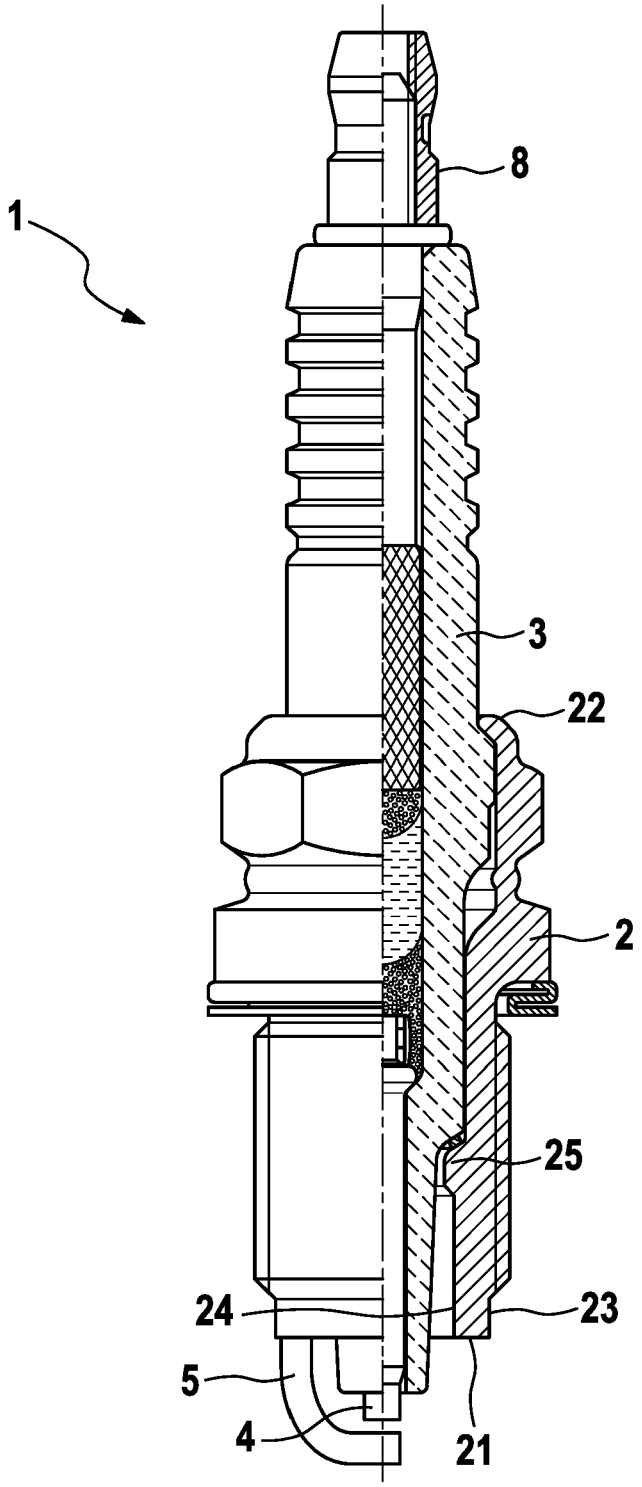
FIG. 2 shows a spark plug in accordance with an example embodiment of the present invention.

FIG. 2 shows a spark plug 1 in a half-sectioned view. Spark plug 1 includes a spark plug housing 2, which has an inner side 24, an outer side 23, an end 21 facing toward the combustion chamber and an end 22 facing away from the combustion chamber. A spark plug insulator 3 is inserted into spark plug housing 2. Spark plug housing 2 and spark plug insulator 3 each have a bore along their longitudinal axis X. The longitudinal axis of spark plug housing 2, the longitudinal axis of spark plug insulator 3, and the longitudinal axis of spark plug 1 coincide. A center electrode 4 is inserted into spark plug insulator 3. Furthermore, a connector pin 8 with a terminal nut, via which spark plug 1 is electrically contactable with a voltage source (not shown here), extends in spark plug insulator 3. Connector pin 8 with the terminal nut form the end of spark plug 1 facing away from the combustion chamber.

A resistor element is located in insulator 3 between center electrode 4 and connector pin 8. The resistor element connects center electrode 4 electrically conductively to connector pin 8.

Insulator 3 rests with a shoulder on a circumferential shoulder 25 formed on inner side 24 of spark plug housing 2. A sealing core, which is plastically deformed when spark plug insulator 3 is clamped in spark plug housing 2 and thus seals off the air gap, is situated between the insulator shoulder and shoulder 25 to seal off the air gap between spark plug housing inner side 24 and insulator 3.

A ground electrode 5 is situated electrically conductively at spark plug housing 2 on its combustion chamber-side end 21. Ground electrode 5 and center electrode 4 are situated in relation to one another in that a spark gap forms between them, in which the ignition spark is generated.

What is claimed is:

1. A spark plug housing, comprising:

an inner side, an outer side, and a longitudinal axis, which extends from an end of the spark plug housing facing toward a combustion chamber up to an end of the spark plug housing facing away from the combustion chamber, the spark plug housing including a circumferential shoulder on the inner side of the spark plug housing, the shoulder being configured so that a spark plug insulator rests on the shoulder;

wherein the spark plug housing includes a corrosion protection layer on the inner side of the spark plug housing, the corrosion protection layer being formed on a section of the inner side of the spark plug housing, the section extending from the end of the spark plug housing facing toward the combustion chamber to at least over the shoulder and along the inner circumference of the spark plug housing, wherein the section on the inner side of the spark plug housing, which is covered by the corrosion protection layer, delimits a breathing space in a spark plug together with a spark plug insulator and thus forms the breathing space, and is protected by the corrosion layer from corrosion at least during use of the spark plug, wherein the corrosion protection layer is phosphorus-free, wherein the corrosion protection layer has a thickness D of at least 2 μm on average, along a circumference of the section and/or along a longitudinal extension of the section, and wherein the thickness D is measured perpendicularly to the inner side of the spark plug housing, wherein the corrosion protection layer has a uniform thickness, which has not more than 10% difference between a thickest and thinnest point.

2. The spark plug housing as recited in claim 1, wherein the corrosion protection layer is a layer applied by electroplating.

3. The spark plug housing as recited in claim 1, wherein the corrosion protection layer contains nickel and/or zinc.

4. The spark plug housing as recited in claim 1, wherein the corrosion protection layer also extends at least 1 mm in a direction of the end of the spark plug housing facing away from the combustion chamber starting from the shoulder.

5. The spark plug housing as recited in claim 1, wherein the spark plug housing only includes the corrosion protection layer on the inner side of the spark plug housing.

6. The spark plug housing as recited in claim 1, wherein the spark plug housing also includes further layers, including one or multiple intermediate layers and/or a sealing layer, in addition to the corrosion protection layer.

7. A spark plug, comprising:

a spark plug housing, including an inner side, an outer side, and a longitudinal axis, which extends from an end of the spark plug housing facing toward a combustion chamber up to an end of the spark plug housing facing away from the combustion chamber, the spark plug housing including a circumferential shoulder on the inner side of the spark plug housing, the shoulder being configured so that a spark plug insulator rests on the shoulder, wherein the spark plug housing includes a corrosion protection layer on the inner side of the spark plug housing, the corrosion protection layer being formed on a section of the inner side of the spark plug housing, the section extending from the end of the spark plug housing facing toward the combustion chamber to at least over the shoulder and along the inner circumference of the spark plug housing;

the spark plug insulator, the spark plug insulating being situated in the spark plug housing;

a center electrode situated in the spark plug insulator; and a ground electrode situated at the end of the spark plug housing facing toward the combustion chamber, the ground electrode and the center electrode being configured to jointly form a spark gap;

wherein the section on the inner side of the spark plug housing, which is covered by the corrosion protection layer, delimits a breathing space in a spark plug together with a spark plug insulator and thus forms the breathing space, and is protected by the corrosion layer from corrosion at least during use of the spark plug, wherein the corrosion protection layer is phosphorus-free, wherein the corrosion protection layer has a thickness D of at least 2 μm on average, along a circumference of the section and/or along a longitudinal extension of the section, and wherein the thickness D is measured perpendicularly to the inner side of the spark plug housing, wherein the corrosion protection layer has a uniform thickness, which has not more than 10% difference between a thickest and thinnest point.

8. A method for manufacturing a spark plug housing, the method comprising:

electroplating at least one section on an inner side of the spark plug housing using a corrosion protection layer, by placing a coating electrode inside the spark plug housing;

wherein the spark plug housing includes the inner side, an outer side, and a longitudinal axis, which extends from an end of the spark plug housing facing toward a combustion chamber up to an end of the spark plug housing facing away from the combustion chamber, the spark plug housing including a circumferential shoulder on the inner side of the spark plug housing, the shoulder being configured so that a spark plug insulator rests on the shoulder, wherein the spark plug housing includes the corrosion protection layer on the inner side of the spark plug housing, the corrosion protection layer being formed on a section of the inner side of the spark plug housing, the section extending from the end of the spark plug housing facing toward the combustion chamber to at least over the shoulder and along the inner circumference of the spark plug housing, wherein the section on the inner side of the spark plug housing, which is covered by the corrosion protection layer, delimits a breathing space in a spark plug together with a spark plug insulator and thus forms the breathing space, and is protected by the corrosion layer from corrosion at least during use of the spark plug, wherein the corrosion protection layer is phosphorus-free, wherein the corrosion protection layer has a thickness D of at least 2 μm on average, along a circumference of the section and/or along a longitudinal extension of the section, and wherein the thickness D is measured perpendicularly to the inner side of the spark plug housing, wherein the corrosion protection layer has a uniform thickness, which has not more than 10% difference between a thickest and thinnest point.

* * * * *